US005522338A

United States Patent [19]

Eilert et al.

[11] Patent Number: 5,522,338

[45] Date of Patent: Jun. 4, 1996

[54] RIB, RIGID-HULL INFLATABLE BOAT

[75] Inventors: John R. Eilert, Fond du Lac; Mark E. Felker, Oshkosh; Edwin B. Hatch, West Bend, all of Wis.

[73] Assignee: Brunswick Corporation, Lake Forest, Ill.

[21] Appl. No.: 282,729

[22] Filed: Jul. 29, 1994

[51] Int. Cl.[6] ..... B63B 7/00

[52] U.S. Cl. ..... 114/345; 114/357; 114/197

[58] Field of Search ..... 114/343, 345, 114/357, 182, 183 R, 197, 198; 441/35, 40

[56] References Cited

U.S. PATENT DOCUMENTS

| | | | |
|---|---|---|---|
| 1,079,627 | 11/1913 | Adams | 114/197 |
| 3,459,150 | 8/1969 | Lunde | 114/183 R |
| 3,565,031 | 2/1971 | DePersia | 114/197 |
| 4,660,497 | 4/1987 | Cochran | 114/345 |
| 4,892,054 | 1/1990 | Davidson | 114/357 |
| 5,184,564 | 2/1993 | Robbins et al. | 114/345 |

FOREIGN PATENT DOCUMENTS

| | | | |
|---|---|---|---|
| 338836 | 10/1989 | European Pat. Off. | 114/345 |
| 3507353 | 9/1986 | Germany | 114/345 |
| 2161429 | 1/1986 | United Kingdom | 114/345 |
| 8601782 | 3/1986 | WIPO | 114/345 |

OTHER PUBLICATIONS

"Applications For Rotational Molding", Association of Rotational Molders, ARM–100–589, May 1989.

"Quicksilver Inflatables", Quicksilver Marine Parts and Accessories, Mercury Marine, Brunswick Corp., Brochure Part No. 90–811303–94, 1994.

"Plastic Kayak Construction", Professional Boat Builder, Jun./Jul. 1994, pp. 33–37.

"Plastic Fantastic", Boating Industry, May 1994, pp. 46–50.

Junglas "Material: PE Unsinkbar", Th. Junglas, Mussumer Str. 3, D–46499 Hamminkeln.

*Primary Examiner*—Stephen Avila

*Attorney, Agent, or Firm*—Andrus, Sceales, Starke & Sawall

[57] ABSTRACT

A RIB, rigid-hull inflatable boat (22) includes an inflatable tube (24) having a general U-shape with a forward end (26) at the bight of the U and trailing sides (28 and 30) extending rearwardly therefrom along the legs of the U. A unitary rotationally molded hull (32) is nested within the tube and has right and left sides (34 and 36) extending along inner surfaces of the tube, and a transom extending between the right and left sides. The hull is detachably secured to the underside of the tube by a mechanical locking device (132) permitting simple detachment and reattachment of the tube to the hull. A recessed channel (188) is provided in a concave surface of the hull engaging the tube and extending around the perimeter of the hull and forming a gutter for draining water aft from the interface between the hull and the tube. The inner sidewalls (208, 212) of the hull extend downwardly and are curved outwardly and below the tube and the respective concave surface to provide an undercut (210, 216) to provide a wider beam and increased floor space. A drain (98) extends through the transom and is provided by a pair of threaded members (102, 104) thread tightened to each other, and a one-way valve permitting drainage out of the boat and blocking reverse flow of water into the boat. A forward pocket-configured compartment (82) receives different types of fuel tanks in differing nested orientations. A bunge system (218, 220) holds the tube against the hull sides at the transom. The transom is strengthened by forward splash guards (40, 42) rearward extensions (44, 46), and anti-compression spacers (48, 50).

39 Claims, 8 Drawing Sheets

FIG. 1
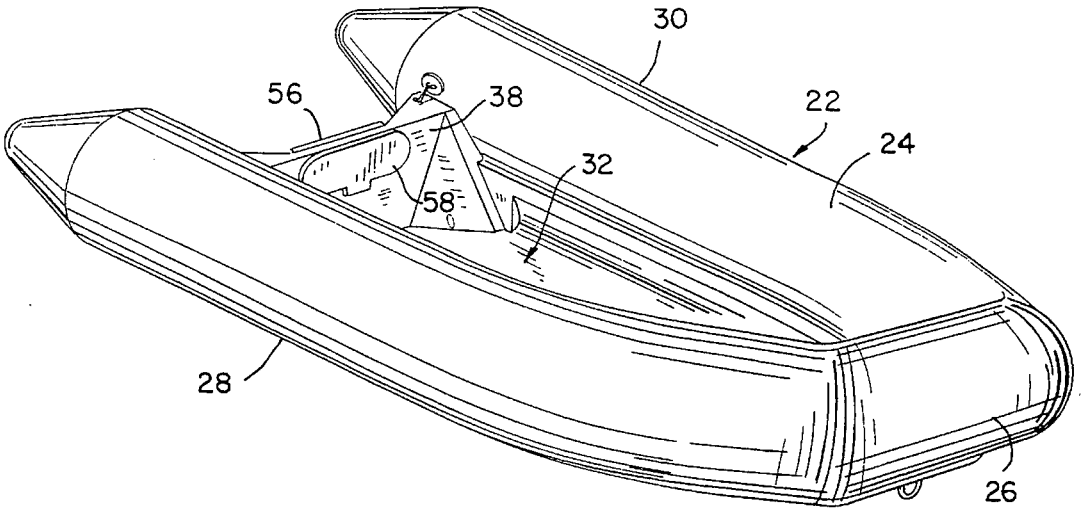
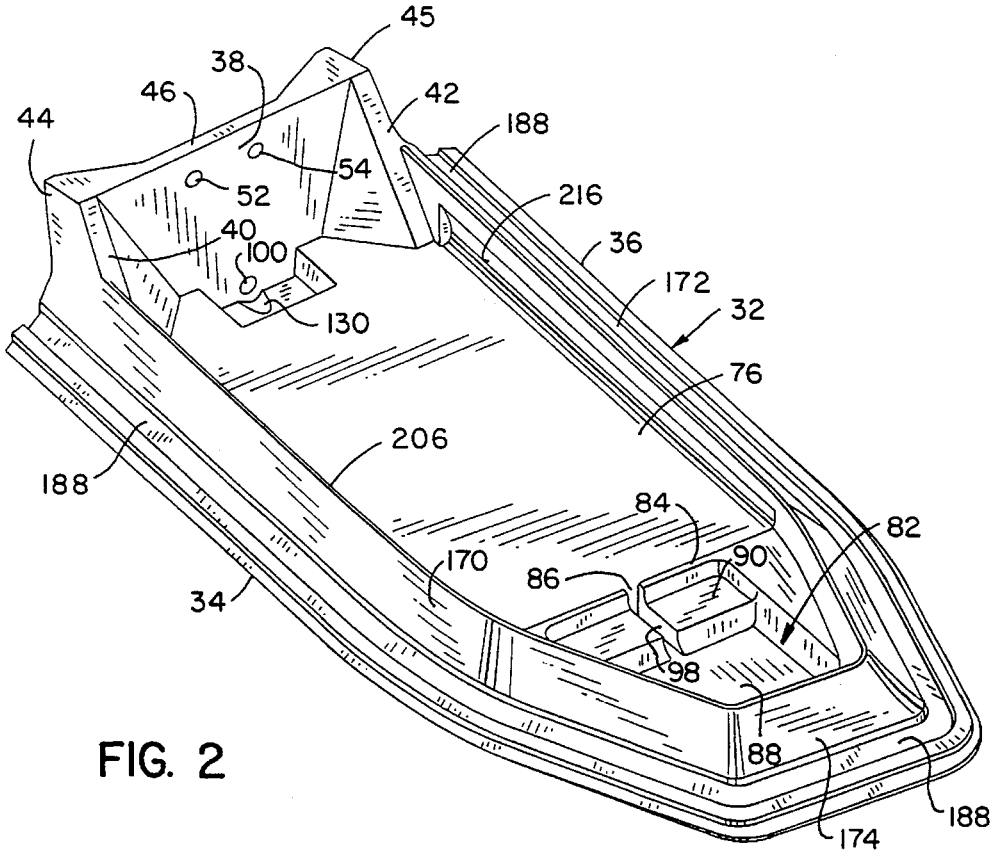
FIG. 2

FIG. 6
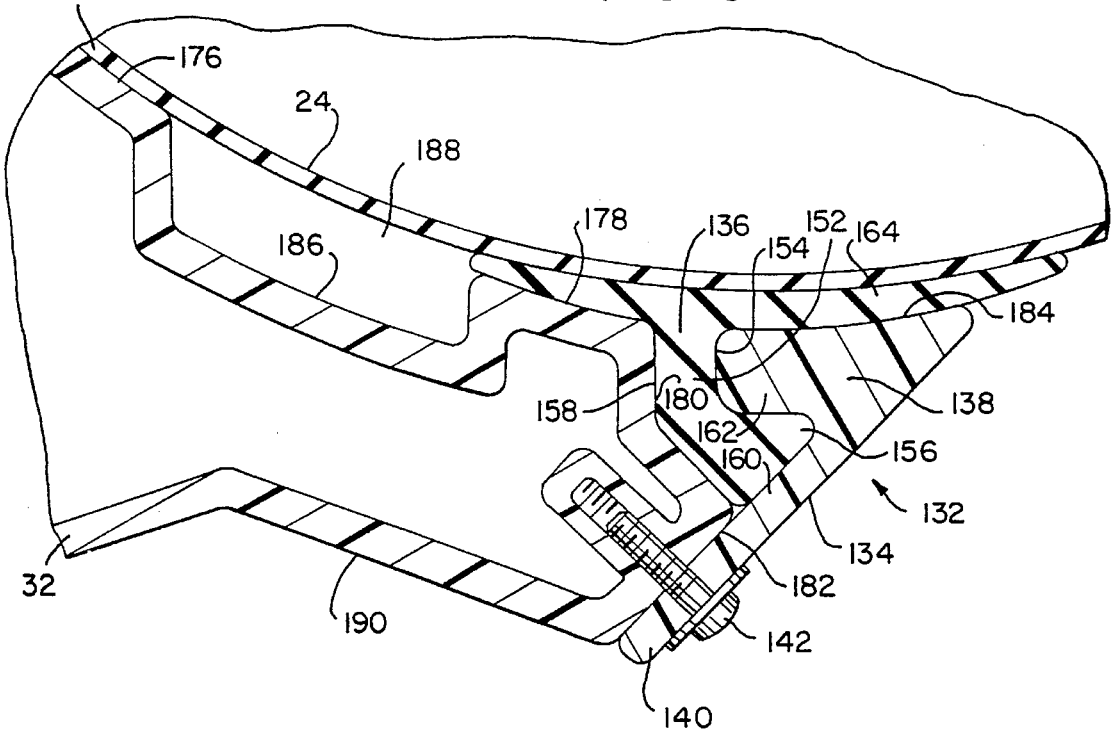
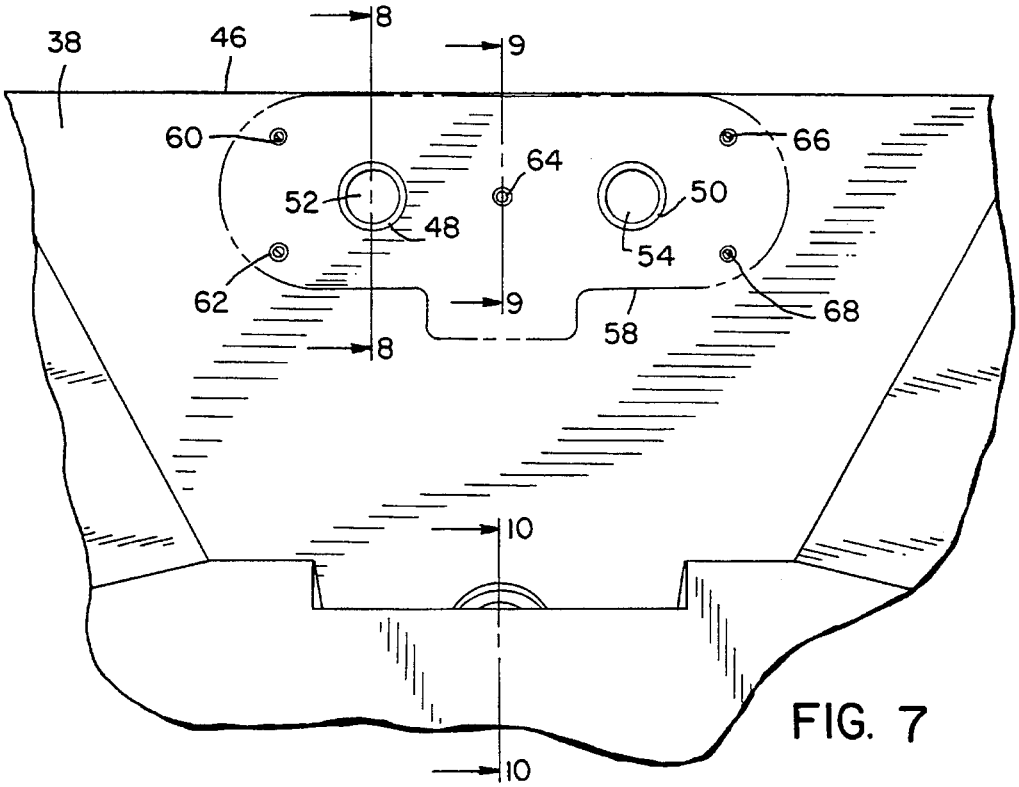
FIG. 7

FIG. 8
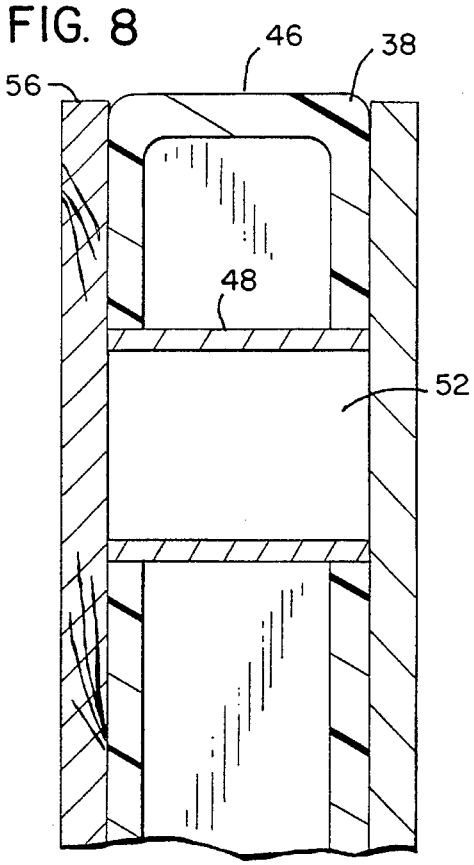
FIG. 9
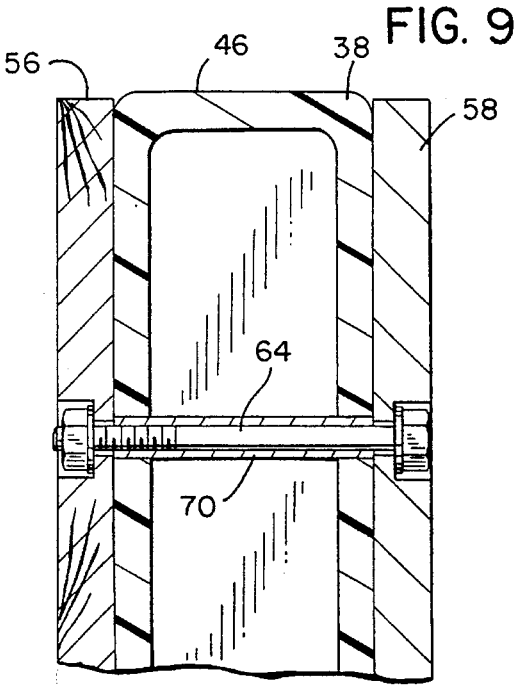
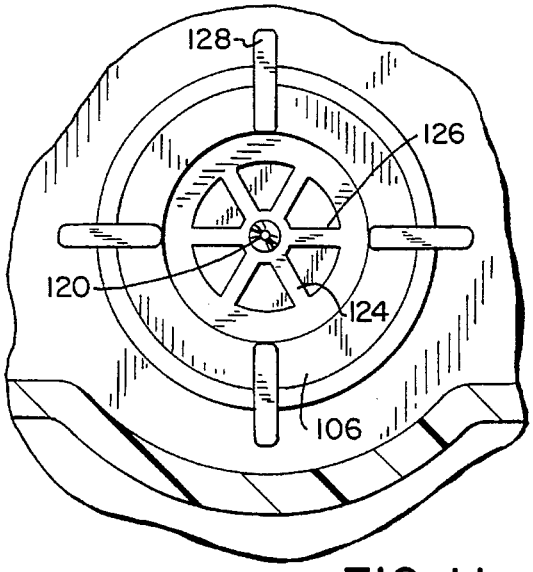
FIG. 11
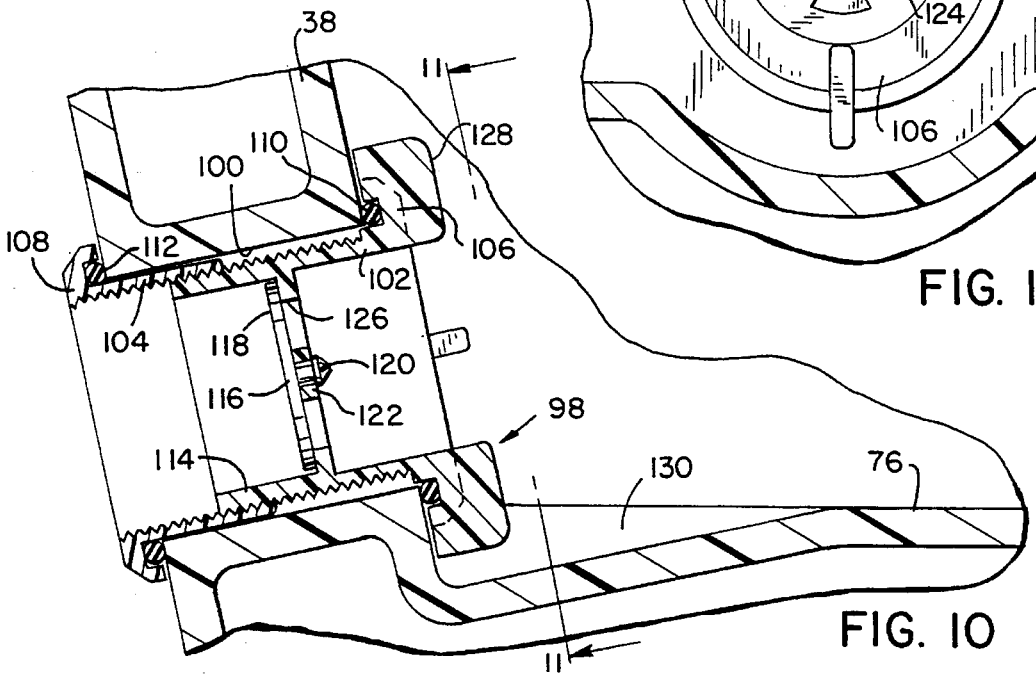
FIG. 10

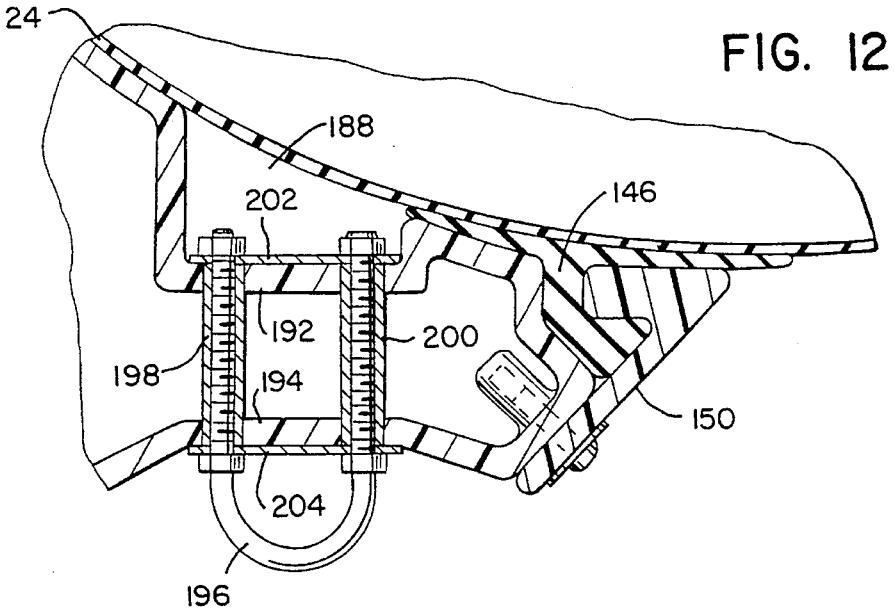
FIG. 12
FIG. 13
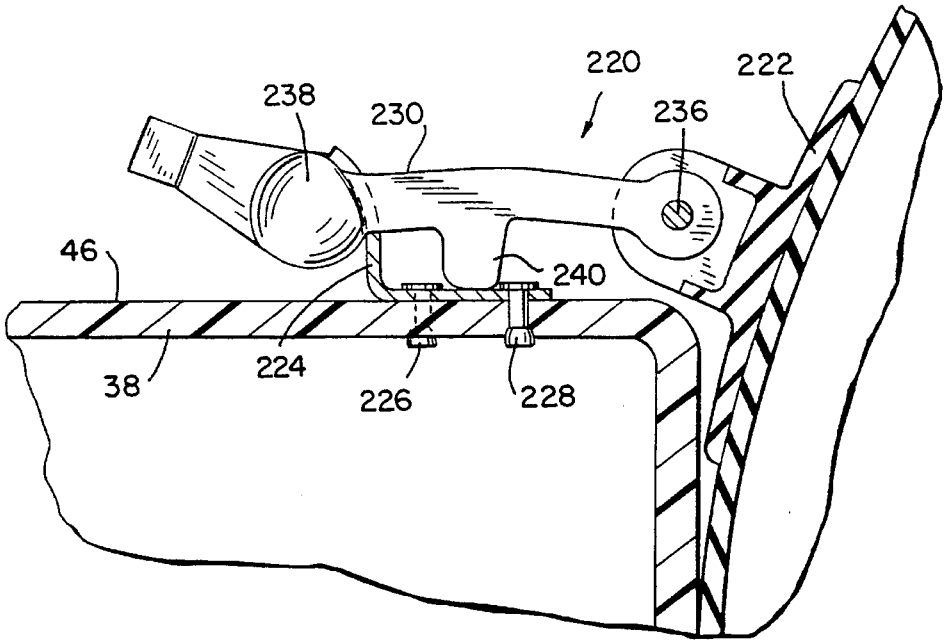

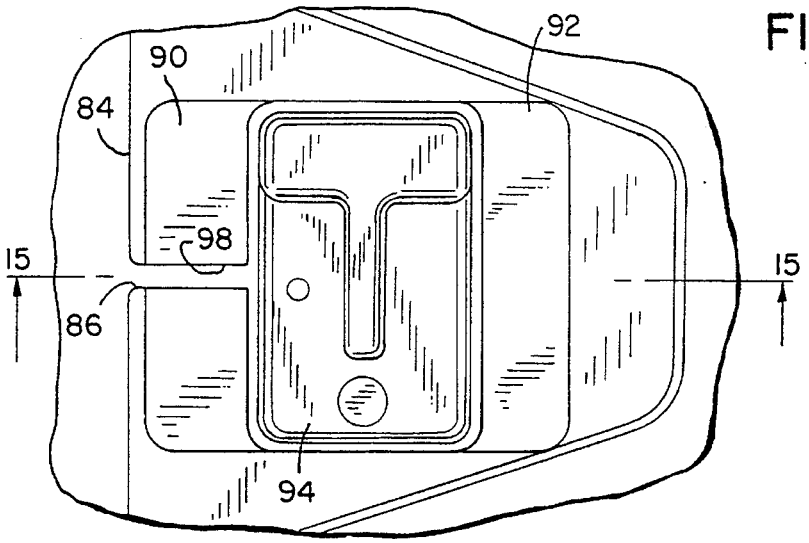
FIG. 14
FIG. 15
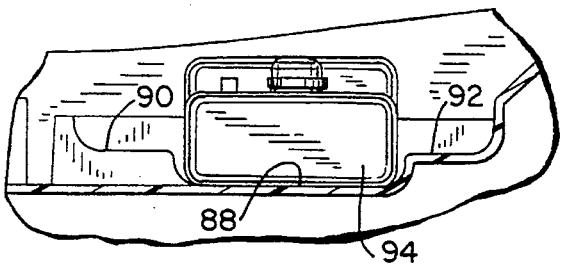
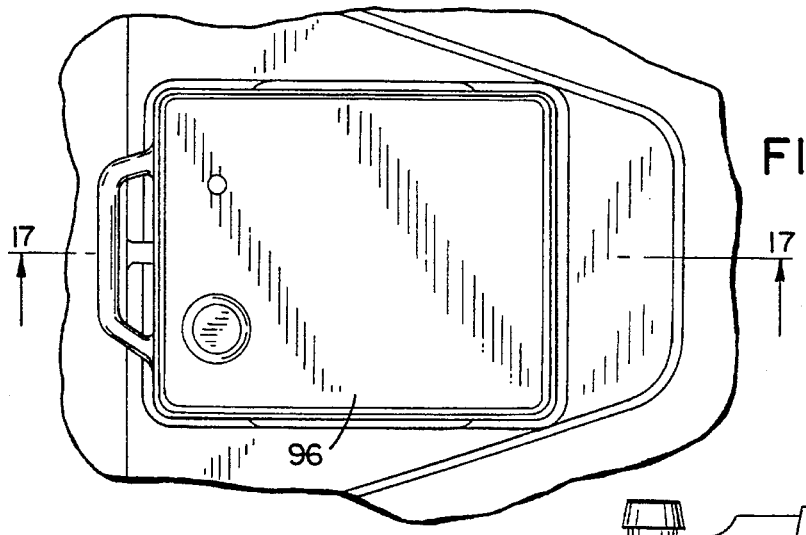
FIG. 16
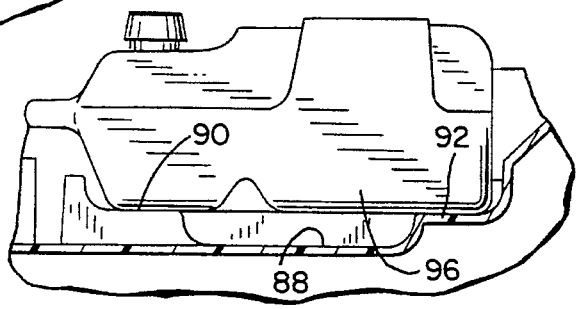
FIG. 17

RIB, RIGID-HULL INFLATABLE BOAT

BACKGROUND AND SUMMARY

The invention relates to a RIB, rigid-hull inflatable boat, and more particularly to improvements in hull construction and attachment.

A rigid-hull inflatable boat includes an inflatable tube having a generally U-shape with a forward end at the bight of the U and trailing sides extending rearwardly therefrom along the legs of the U. A hull is nested to the underside of the tube and attached thereto. The hull has an aft transom for mounting an outboard motor, and has a deck extending forwardly therefrom for supporting the occupants. Prior art hulls are typically made of fiberglass, and are formed as two clamshell halves which are then bonded to each other along a generally horizontal parting line. The assembled hull is then nested to the underside of the tube and attached thereto by tape and/or glue.

The present invention provides a simplified, lighter weight, lower cost hull construction. In one aspect of the invention, the fiberglass clamshell halves are eliminated, and instead a unitary rotationally molded hull is provided, preferably of polyethylene.

In another aspect of the invention, taping and gluing of the hull to the tube is eliminated, and instead a simple mechanical locking device is provided having a releasable clamp permitting detachment and reattachment of the tube to the hull in a simple, user-friendly manner.

In another aspect of the invention, a gutter system is provided for draining water from the interface between the hull and the tube, to minimize squirting of water from such interface back into the boat when the tube is squeezed or otherwise pushed against the hull.

In another aspect, the deck of the hull has a forward pocket-configured compartment receiving differing type fuel tanks in nested relation in the bow. In another embodiment, the deck is a substantially flat surface all the way forwardly from the transom to the bow, without a forward pocket-configured compartment.

In another aspect of the invention, the transom is provided with anti-compression spacers preventing collapse of the transom under transom bracket clamping pressure. In another embodiment, the top of the transom is open, and a transom board, e.g. plywood, is inserted therein.

In another aspect of the invention, integrally formed splash guards extend from the transom forwardly to the hull sides and strengthen the transom.

In another aspect, the hull sides extend rearwardly beyond the transom and include aft sections extending upwardly and then inwardly and forwardly to the top of the transom to strengthen the transom.

In another aspect of the invention, a drain is provided through the transom by a pair of threaded members thread tightened to each other and providing simplified sealing without gluing the drain to the transom as in the prior art.

In another aspect of the invention, the deck of the hull is joined to the upper reach of the concave surface of the outer sidewall by an inner sidewall extending downwardly from the upper reach and curved outwardly and below the tube and the concave surface to provide an undercut in the inner sidewall to provide a wider beam and increased floor space within the boat.

In another aspect of the invention, a keel board may be provided between the lower keel and the deck and have mouse holes therethrough permitting flow of material therethrough during rotational molding.

In another aspect of the invention, a bunge system is provided to hold the tube to the hull at the transom.

In another aspect of the invention, a bow eye attachment is provided by a U-bolt extending through parallel extended surfaces of the gutter drain channel and lower surface of the hull.

BRIEF DESCRIPTION OF THE DRAWINGS

FIG. 1 is a perspective view of a RIB, rigid-hull inflatable boat, constructed in accordance with the invention.

FIG. 2 is a perspective view of the hull of FIG. 1.

FIG. 6 is a sectional view taken along line 6—6 of FIG. 4.

FIG. 7 is a view from the front of a portion of the rear transom of FIG. 1.

FIG. 8 is a sectional view taken along line 8—8 of FIG. 7.

FIG. 9 is a sectional view taken along line 9—9 of FIG. 7.

FIG. 10 is a sectional view taken along line 10—10 of FIG. 7.

FIG. 11 is a view taken along line 11—11 of FIG. 10.

FIG. 12 is a sectional view taken along line 12—12 of FIG. 4.

FIG. 13 is a sectional view taken along line 13—13 of FIG. 4.

FIG. 14 is a top view of a portion of the structure of FIG. 2, and additionally shows a fuel tank nested therein.

FIG. 15 is a view taken along line 15—15 of FIG. 14.

FIG. 16 is a top view of a portion of the structure of FIG. 2, and additionally shows another type of fuel tank nested therein.

FIG. 17 is a view taken along line 17—17 of FIG. 16.

DETAILED DESCRIPTION

FIG. 1 shows a RIB 22, rigid-hull inflatable boat. An inflatable tube 24 has a general U-shape with a forward end 26 at the bight of the U and trailing sides 28 and 30 extending rearwardly therefrom along the legs of the U. A unitary rotationally molded hull 32, FIGS. 1–5, preferably polyethylene, is nested within the tube and attached thereto, to be described. Rotational molding, or roto-molding, is known in the art, and involves loading resin into a mold, followed by heating and fusion of the resin during biaxial rotation of the mold such that the resin material fills and forms a layer along the outer periphery of the mold inner-cavity, followed by cooling prior to unloading the mold, with the product retaining the shape of the cavity periphery, for which further reference may be had to "Applications For Rotational Molding", Association of Rotational Molders, ARM-100–589, May 1989. The advantages of rotationally molding hull 32 is the lighter weight unitary construction enabled thereby, as opposed to prior heavier fiberglass assembled clamshell hulls. Rotationally molded hull 32 is a single unitary member of lighter weight than prior hulls, and eliminates the need to assemble and bond clamshell halves together.

Figure 3:
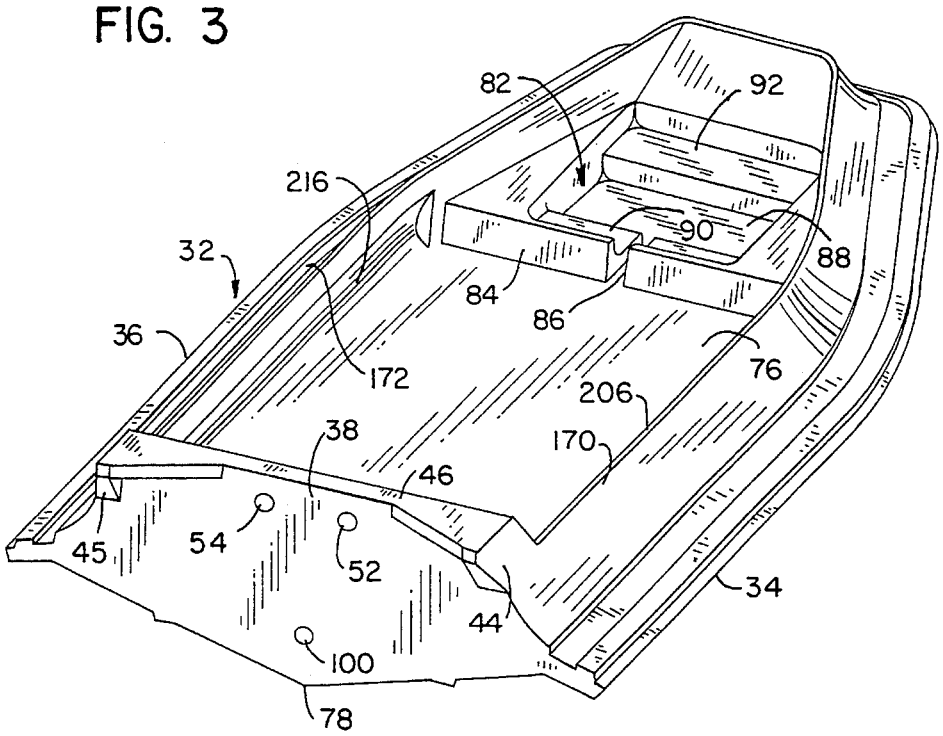
FIG. 3 is a perspective view from the rear of the hull of FIG. 2.

Hull 32 has right and left sides 34 and 36, FIGS. 2 and 3, extending along the inner surfaces of the tube sides, and a transom 38 extending between the right and left sides 34 and 36. Integrally formed right and left splash guards 40 and 42 extend from transom 38 forwardly to respective sides 34 and 36 and strengthen the transom. Sides 34 and 36 extend rearwardly beyond transom 38 and include aft sections 44 and 45 extending upwardly and then inwardly and forwardly to the top 46 of the transom to further strengthen the transom.

In one embodiment, the hull, including the transom, is hollow, and anti-compression spacers 48 and 50, FIGS. 7 and 8, are provided in respective holes 52 and 54 through the transom. The anti-compression spacers prevent collapse of the transom under transom bracket clamping pressure. A stiffener board 56, FIGS. 8 and 9, e.g. plywood, is provided on the aft side of transom 38, and a mounting plate 58 is provided on the front side of the transom. Bolts 60, 62, 64, 66, 68, FIGS. 7 and 9, extend through the transom and secure stiffener board 56 and mounting plate 58 thereto. Each of the mounting bolts may include an anti-compression sleeve 70 there-around further preventing collapse of the transom.

In another embodiment, the hull, including the transom, is foam filled, in which embodiment the anti-compression spacers are preferably eliminated because the hardened foam has sufficient rigidity to withstand transom bracket clamping pressure.

Figure 20:
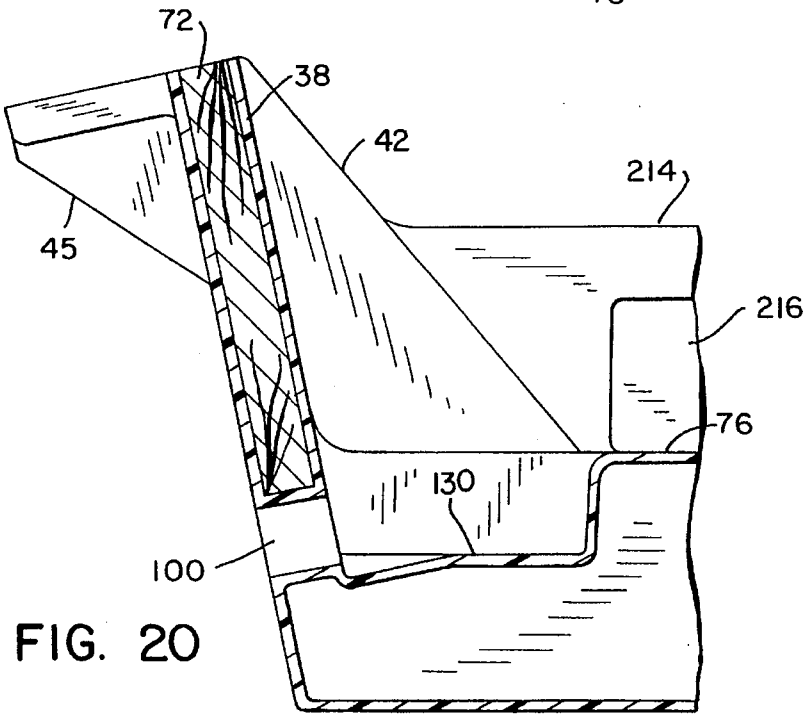
FIG. 20 is a sectional view of a portion of the structure of FIG. 2, and shows an alternate embodiment.

In another embodiment, the top of the transom is open, FIG. 20, and a transom board 72, e.g. plywood, is inserted therein.

Figure 18:
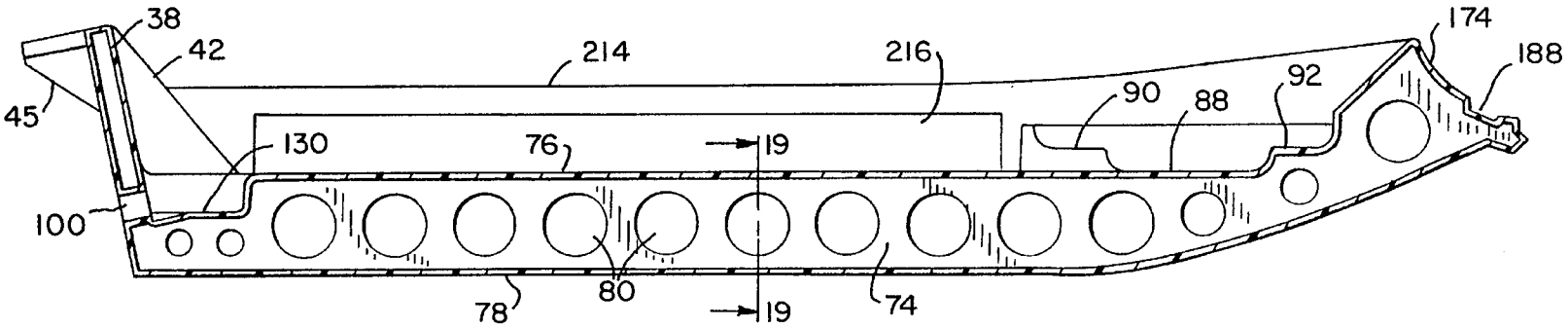
FIG. 18 is a view taken along a fore-to-aft sectional line of the structure of FIG. 2, and shows a further embodiment.
Figure 19:
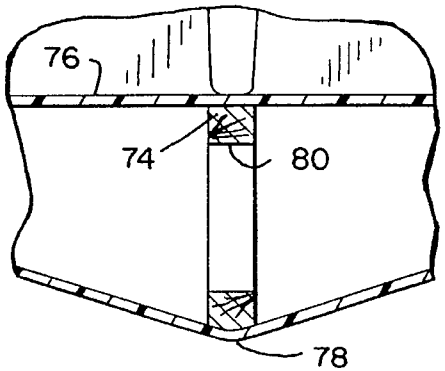
FIG. 19 is a sectional view taken along line 19—19 of FIG. 18.

In a further embodiment, a keel board 74, FIGS. 18 and 19, extends vertically between deck 76 and lower keel 78 and spans the gap therebetween and maintains the deck and keel in spaced relation. The keel board is in the mold during rotational molding and has a plurality of mouse holes 80 therein, FIG. 19, permitting flow of the resin material therethrough during rotational molding. It is preferred that keel board 74 not be used when the hull is foam filled.

Deck 76, FIGS. 2 and 3, extends forwardly from transom 38 between right and left sides 34 and 36. The hull has a forward pocket-configured compartment 82 receiving one or more fuel tanks in nested relation, FIGS. 14–17. Forward compartment 82 is separated from deck 76 by a wall 84, FIGS. 2 and 3, having an opening 86 therein for drainage of water rearwardly therethrough from forward compartment 82. Forward compartment 82 has a first central lower floor 88 spaced between second and third floors 90 and 92 raised thereabove. Floor 88 receives a first type fuel tank 94, FIGS. 14 and 15, nested between floors 90 and 92. In an alternate fuel tank arrangement, floors 90 and 92 receive a second type fuel tank 96, FIGS. 16 and 17, spanning and spaced above floor 88. Floor 90 is spaced rearwardly of floor 92 by floor 88 therebetween. Floor 90 has a rearwardly extending channel 98, FIG. 2, formed therethrough and aligned with opening 86 in wall 84 and funneling water to opening 86, to drain water from floor 88 rearwardly through channel 98 in floor 90 and through opening 86 in dividing wall 84. In another embodiment, the deck is a substantially flat surface all the way forwardly from the transom to the bow, without a forward pocket-configured compartment.

A drain 98, FIGS. 10 and 11, extends through a hole 100, FIGS. 2 and 3, in transom 38. Drain 98 includes a pair of threaded members 102 and 104 each having an outer flange 106 and 108, respectively. Threaded members 102 and 104 are thread tightened to each other to urge flange 106 of member 102 toward the forward side of transom 38, and to urge flange 108 of member 104 toward the aft side of transom 38. Sealing O-ring 110 is compressed between flange 106 and the front side of the transom. Sealing O-ring 112 is compressed between flange 108 and the aft side of transom 38. Members 102 and 104 have a central passage 114 therethrough with a one-way valve 116 permitting drainage of water out of the boat, and blocking reverse flow of water into the boat. Valve 116 is an umbrella type flap valve having a flexible rubber disc 118 anchored by central stem 120 to the central hub 122 of a plurality of spokes 124 extending radially outwardly therefrom to the inner sidewall of member 102 and having a plurality of openings 126 therebetween through which water flows leftwardly in FIG. 10 and deflects flap type disc 118 leftwardly to permit discharge of water. A plurality of outer ribs 128 permit gripping and turning of member 102 from inside the boat to facilitate disassembly of the drain if desired. Deck 76 has a recessed floor section 130, FIG. 2, immediately forward of the drain and funneling water thereto.

Hull 32 is nested within tube 24 and detachably secured thereto by a mechanical locking device 132, FIG. 6, having a releasable clamp 134 permitting detachment and reattachment of tube 24 to hull 32. Locking device 132 includes a hook 136 bonded to tube 22. Clamp 134 has a first outer portion 138 engaging hook 136, and a second inner portion 140 engaging hull 32 and preferably attached thereto by a threaded bolt 142. Hook 136 is preferably a relatively hard rubber extruded member extending fore to aft along the entire length of the underside of the right side 28 of the tube. Another comparable extruded hard rubber hook member 144, FIG. 5, extends along the underside of the left side 30 of the tube. A third hard rubber extruded hook member 146, FIG. 12, extends along the underside of the front 26 of the tube and mates with the respective right and left extended hook members 136 and 144. Clamps 134, 148 and 150 are preferably plastic members extending along the length of the respective hooks 136, 144 and 146.

Hook 136, FIG. 6, has a post 152 extending away from tube 22. Post 152 has an outer side 154 facing outwardly away from hull 32. Side 154 has a knuckle 156 extending therefrom away from hull 32. Post 152 has an inner side 158 facing inwardly toward and engaging the hull. Clamp 134 has a middle portion 160 extending across post 152. Portion 138 of clamp 134 has a finger 162 curled around knuckle 156 and engaging hook 136 at outer side 154 of post 152 between knuckle 156 and tube 22. Hook 136 includes a base pad 164 bonded to the underside of tube 22, preferably by glue. Post 152 extends downwardly and outwardly from base pad 164. Inner side 158 of the post extends downwardly and outwardly away from the hull such that detachment of clamp 134 by unbolting same from the hull enables the hull to slide downwardly away from tube 22 along inner side 158 of post 152. This type of downward direct detachment displacement of the hull from the tube, or upward displacement of the tube from the hull, is simple and user friendly. Hooks 144 and 146 are comparable. A plurality of bolts such as 142 are spaced along the mounting system, and the user merely removes the bolts, and lifts the tube off the hull. This type of mechanical locking device having a releasable clamp permits simple detachment and reattachment of the tube to the hull. There is no gluing or taping of the tube to the hull, but rather a mechanical locking arrangement with simple detachment and reattachment orientation and separation.

Figure 5:
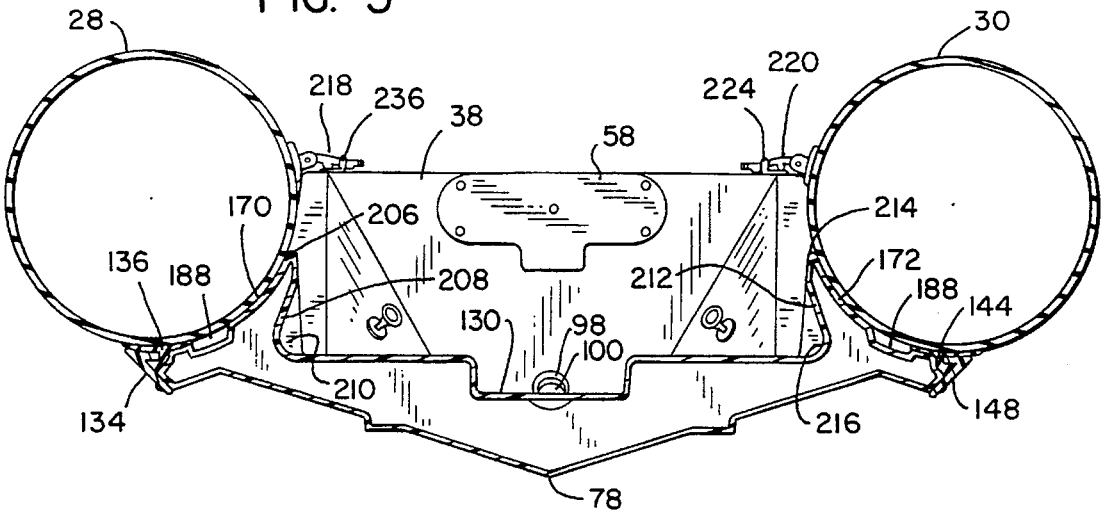
FIG. 5 is a sectional view taken along line 5—5 of FIG. 4.

The hull right side 34 has a concave surface 170, FIGS. 2, 3 and 5, engaging the inner underside of right tube side 28. Left hull side 36 has a concave surface 172 engaging the inner underside of left tube side 30. The front of the hull has a concave surface 174 engaging the inner underside of the front 26 of the tube. Concave surface 170 has an upper surface 176, FIG. 6, engaging the tube, and an upper surface 178 spaced outwardly of surface 176 and engaging base pad 164. The hull has an outer surface 180 extending downwardly and outwardly from surface 178 and engaging inner side 158 of post 152. The hull has a lower surface 182 extending inwardly and downwardly from surface 180 and engaging portion 140 of clamp 134. The clamp has an upper surface 184 along finger 162 engaging base pad 164. The clamp extends downwardly and inwardly from the finger along post 152 and then along surface 182 of the hull. Surfaces 176 and 178 support tube 24 and are spaced by an upper surface 186 recessed below tube 24 and forming a channel 188 therebetween, to be described. The hull has a lower surface 190 extending inwardly from surface 182 and generally parallel to surface 186. Clamp 134 spans hook 136 and has an inner portion 140 engaging the hull and an outer portion 138 engaging the outer surface of the hook 136 such that detachment of clamp 134 enables the hull to slide downwardly away from the tube along inner surface 158 of the hook. The mounting system along concave surfaces 172 and 174 is comparable.

The concave surfaces 170, 174, 172 engaging tube 22 extend along the U-shape thereof and have the noted recessed channel 188 extending fore to aft there-along and forming a gutter such that water flowing over the top of tube 24 and then downwardly along the interface between the tube and the hull flows into such gutter. Channel 188 is open at the aft end of the hull such that water in the gutter drains aft. As noted above, the hull is nested to the underside of the tube, and the concave surface has upper and lower sections 176 and 178 spaced by channel 188 therebetween. The hull is detachably secured to the tube by the noted mechanical locking device 132 having a releasable clamp 134 permitting detachment and reattachment of the tube to the hull, and including a hook 136 bonded to the underside of the tube. The clamp clamps the hull to the hook at the noted lower section 178 of the concave surface. The gutter formed by channel 188 extends around the perimeter of the hull in a general U-shape parallel to the U-shape of tube 24.

Channel 188 and the lower surface of the hull have parallel extended surfaces 192, 194, FIG. 12, at the front of the boat receiving a U-bolt 196 extending there-through, providing a bow eye attachment. Anti-compression spacers 198 and 200 extend between plates 202 and 204 on surfaces 192 and 194.

Concave surface 170, FIGS. 2, 3 and 5, of the outer sidewall of the hull has an upper reach 206 within the boat. Upwardly facing deck 76 of the hull is below upper reach 206 and is joined thereto by an inner side-wall 208, FIG. 5, extending downwardly from upper reach 206 and curved outwardly and below tube 24 and concave surface 170 and toward channel 188 to provide an undercut 210 in the inner sidewall 208 to provide a wider beam and increased floor space within the boat. The left inner sidewall 212 of the hull likewise extends downwardly from upper reach 214 of concave surface 172 and is curved outwardly and below tube 24 and concave surface 172 to provide an undercut 216 in inner sidewall 212.

Figure 4:
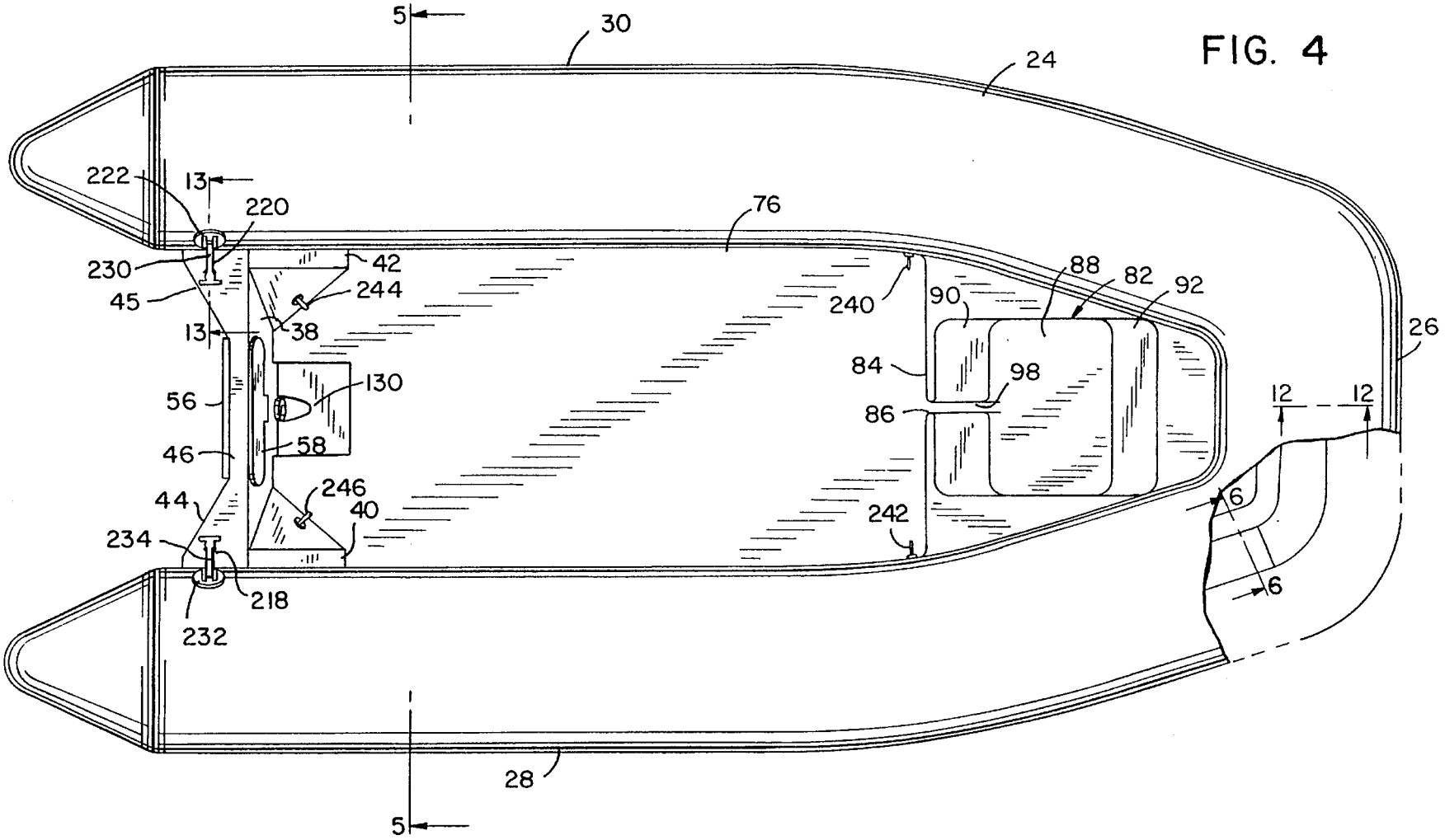
FIG. 4 is a top view, partially cut away, of the RIB of FIG. 1.

Right and left mechanical clamping devices 218 and 220, FIGS. 4 and 5, releasably hold tube 24 against the right and left sides 34 and 36 of the hull at transom 38. Each clamping device includes a base pad 222, FIG. 13, bonded to tube 24, preferably by gluing, a clasp 224 mounted to the top 46 of transom 38, preferably by rivets 226, 228, and a holding member 230 extending therebetween. In the preferred embodiment, right and left bunge pads 232 and 222 are bonded to tube 24, and each mounts a respective bunge cord 234 and 230. Right and left clasps 236 and 224 are mounted to the transom and receive a respective bunge cord for holding tube 24 against hull sides 34 and 36 at transom 38. Pad 222 pivotally mounts bunge cord 230 at pivot pin 236. The bunge cord is a resilient rubber member having an enlarged end 238 received in clasp 224, which is preferably a split finger member. Bunge cord 230 has a lower knob 240 spaced between enlarged end 238 and pad 222. Knob 240 engages transom 38 and bows the central portion of bunge cord 230 upwardly away from the transom. Clamping device 218 is comparable.

The hull is provided with davit lifting eyes 240, 242, 244, 246, FIG. 4, bolted thereto.

It is recognized that various equivalents, alternatives and modifications are possible within the scope of the appended claims.

We claim:

1. A RIB, rigid-hull inflatable boat, comprising an inflatable tube having a general U-shape with a forward end at the bight of the U and trailing sides extending rearwardly therefrom along the legs of the U, a unitary rotationally molded hull nested within said tube and attached thereto, said hull having right and left sides extending along inner surfaces of said tube, and a transom extending between said right and left sides, said transom being unitary and integral with said hull and said sides and nondetachable therefrom, splash guards extending from said transom forwardly to said sides and strengthening said transom, said splash guards being unitary and integral with said transom and said sides.

2. The invention according to claim 1 comprising a drain extending through said transom, said drain comprising a pair of threaded members each extending partially through said transom in overlapped telescoping relation and each having an outer flange and being thread tightened to each other within said transom to urge the flange of one member toward one side of said transom, and the flange of the other member toward the other side of said transom, said members having a central passage therethrough with one-way valve permitting drainage of water out of the boat and blocking reverse flow of water into the boat.

3. The invention according to claim 2 comprising a first sealing O-ring compressed between said one flange and said one side of said transom, and a second sealing O-ring compressed between said other flange and said other side of said transom.

4. The invention according to claim 2 wherein said hull comprises a deck within the boat extending forwardly from said transom, said deck having a recessed floor section immediately forward of said drain and funneling water thereto.

5. The invention according to claim 1 comprising right and left bunge base pads bonded to said tube and each mounting a respective bunge cord, and comprising right and left clasps mounted to said transom and receiving a respective bunge cord for holding said tube against said sides at said transom.

6. The invention according to claim 5 wherein said pad pivotally mounts said bunge cord, and wherein said bunge cord comprises a resilient rubber member having an enlarged end receiving in said clasp.

7. The invention according to claim 1 wherein said transom is hollow, and comprising anti-compression spacers extending through said transom and preventing collapse of the latter under transom bracket clamping pressure.

8. The invention according to claim 1 comprising a stiffener board on one side of said transom and a mounting plate on the other side of said transom, and comprising a plurality of bolts extending through said transom and securing said stiffener board and mounting plate thereto.

9. The invention according to claim 1 wherein said hull has a lower surface with a keel extending fore to aft, and an upwardly facing deck within the boat extending forwardly from said transom and spaced above said keel by a gap therebetween, and comprising a keel board extending vertically between said deck and said keel and spanning the gap therebetween and maintaining said deck and said keel in spaced relation.

10. The invention according to claim 9 wherein said keel board has a plurality of mouse holes therein permitting flow of material therethrough during rotational molding.

11. The invention according to claim 1 wherein said hull including said transom is foam filled.

12. The invention according to claim 1 comprising a transom board within said transom.

13. A RIB, rigid-hull inflatable boat, comprising an inflatable tube having a general U-shape with a forward end at the bight of the U and trailing sides extending rearwardly therefrom along the legs of the U, a unitary rotationally molded hull nested within said tube and attracted thereto, said hull having right and left sides extending along inner surfaces of said tube, and a transom extending between said right and left sides, said transom being unitary and integral with said hull and said sides and nondetachable therefrom, wherein said sides extend rearwardly beyond said transom and include aft sections extending upwardly and then inwardly and forwardly to the top of said transom to strength said transom, said aft sections beings unitary and integral with said transom and said sides.

14. A RIB, rigid-hull inflatable boat, comprising an inflatable tube having a general U-shape with a forward end at the bight of the U and trailing sides extending rearwardly therefrom along the legs of the U, a unitary rotationally molded hull nested within said tube and attached thereto, said hull having right and left sides extending along inner surfaces of said tube, and a transom extending between said right and left sides, said transom being unitary and integral with said hull and said sides and nondetachable therefrom, wherein said hull has a deck extending forwardly from said transom between said sides, and a forward pocket-configured compartment receiving one or more fuel tanks in nested relation, said forward compartment being separated from said deck by a wall having an opening therein for drainage of water rearwardly therethrough from said forward compartment.

15. A RIB, rigid-hull inflatable boat, comprising an inflatable tube having a general U-shape with a forward end at the bight of the U and trailing sides extending rearwardly therefrom along the legs of the U, a unitary rotationally molded hull nested within said tube and attached thereto, said hull having right and left sides extending along inner surfaces of said tube, and a transom extending between said right and left sides, wherein said hull has a deck extending forwardly from said transom between said sides, and a forward pocket-configured compartment receiving one or more fuel tanks in nested relation, said forward compartment being separated from said deck by a wall having an opening therein for drainage of water rearwardly therethrough from said forward compartment, said forward compartment comprises a first central lower floor spaced between second and third floors raised thereabove, said first floor receiving a first type fuel tank nested between said second and third floors, said second and third floors receiving a second type fuel tank spanning and spaced above said first floor.

16. The invention according to claim 15 wherein said second floor is spaced rearwardly of said third floor by said first floor therebetween, and wherein said second floor has a rearwardly extending channel formed therethrough and funneling water to said opening in said dividing wall, to drain water from said first floor rearwardly through said channel in said second floor and through said opening in said dividing wall.

17. A RIB, rigid-hull inflatable boat, comprising an inflatable tube having a general U-shape with a forward end at the bight of the U and trailing sides extending rearwardly therefrom along the legs of the U, a unitary rotationally molded hull nested within said tube and attached thereto, said hull having right and left sides extending along inner surfaces of said tube, and a transom extending between said right and left sides, said transom being unitary and integral with said hull and said sides and nondetachable therefrom, wherein said hull is detachably secured to the underside of said tube by a mechanical locking device having a releasable clamp permitting detachment and reattachment of said tube to said hull, said detachment and reattachment being in upward and downward directions perpendicular to the direction of travel of said boat.

18. The invention according to claim 17 wherein said locking device comprises a hook bonded to the underside of said tube, said hook having an inner surface facing and engaging said hull and extending downwardly and outwardly, said hook having an outer surface facing oppositely from said inner surface, said clamp spanning said hook and having an inner portion engaging said hull and an outer portion engaging said outer surface of said hook such that detachment of said clamp enables said hull to slide downwardly away from said tube along said inner surface of said hook.

19. A RIB, rigid-hull inflatable boat, comprising an inflatable tube having a general U-shape with a forward end at the bight of the U and trailing sides extending rearwardly therefrom along the legs of the U, a unitary rotationally molded hull nested within said tube and attached thereto, said hull having right and left sides extending along inner surfaces of said tube, and a transom extending between said right and left sides, said transom being unitary and integral with said hull and said sides and nondetachable therefrom, wherein said hull has a concave surface engaging said tube and extending along the U-shape thereof, said concave surface having a recessed channel extending fore to aft therealong and forming a gutter such that water flowing over the top of the tube and then downwardly along the interface between said tube and said hull flows into said gutter, said channel being open at the aft end of said hull such that water in said gutter drains aft.

20. A RIB, rigid-hull inflatable boat, comprising an inflatable tube having a general U-shape with a forward end at the bight of the U and trailing sides extending rearwardly therefrom along the legs of the U, a unitary rotationally molded hull nested within said tube and attached thereto, said hull having right and left sides extending along inner surfaces of said tube, and a transom extending between said right and left sides, and transom being unitary and integral with said hull and said sides and nondetachable therefrom, wherein said hull has an outer sidewall with a concave surface engaging said tube, said concave surface having an upper reach within the boat, said hull having an upwardly facing deck within the boat below said upper reach, said deck being joined to said upper reach by an inner sidewall extending downwardly from said upper reach and curved outwardly and below said tube and said concave surface to provide an undercut in said inner sidewall to provide a wider beam and increased floor space within the boat.

21. A RIB, rigid-hull inflatable boat, comprising an inflatable tube having a general U-shape with a forward end at the bight of the U and trailing sides extending rearwardly therefrom along the legs of the U, a unitary rotationally molded hull nested within said tube and attached thereto, said hull having right and left sides extending along inner surfaces of said tube, and a transom extending between said right and left sides, right and left bunge base pads bonded to said tube and each mounting a respective bunge cord, right and left clasps mounted to said transom and receiving a respective bunge cord for holding said tube against said sides at said transom, wherein said pad pivotally mounts said bunge cord, said bunge cord comprises a resilient rubber member having an enlarged end received in said clasp, and said bunge cord has a lower knob spaced between said enlarged end and said pad, said knob engaging said transom and bowing the central portion of said bunge cord upwardly away from said transom.

22. A RIB, rigid-hull inflatable boat, comprising an inflatable tube having a general U-shape with a forward end at the bight of the U and trailing sides extending rearwardly therefrom along the legs of the U, a hull nested within said tube and detachably secured thereto by a mechanical locking device having a releasable clamp permitting detachment and reattachment of said tube to said hull, said detachment and reattachment being in upward and downward directions perpendicular to the direction of travel of said boat.

23. The invention according to claim 22 wherein said locking device comprises a hook bonded to said tube, and wherein said clamp has a first portion engaging said hook, and a second portion engaging said hull.

24. The invention according to claim 22 wherein said hull has first and second upper surfaces supporting said tube and spaced by a third upper surface recessed below said tube and forming a channel therebetween.

25. The invention according to claim 22 wherein:

said hull is nested to the underside of said tube;

said locking device comprises a hook bonded to the underside of said tube;

said hook has an inner surface facing and engaging said hull and extending downwardly and outwardly;

said hook has an outer surface facing oppositely from said inner surface;

said clamp spans said hook and has an inner portion engaging said hull and an outer portion engaging said outer surface of said hook such that detachment of said clamp enables said hull to slide downwardly away from said tube along said inner surface of said hook.

26. A RIB, rigid-hull inflatable boat, comprising an inflatable tube having a general U-shape with a forward end at the bight of the U and trailing sides extending rearwardly therefrom along the legs of the U, a hull nested within said tube and detachably secured thereto by a mechanical locking device having a releasable clamp permitting detachment and reattachment of said tube to said hull, wherein:

said locking device comprises a hook bonded to said tube;

said clamp has a first portion engaging said hook, and a second portion engaging said hull;

said hook comprises a post extending away from said tube;

said post has a first side facing outwardly away from said hull;

said first side has a knuckle extending therefrom away from said hull;

said post has a second side facing inwardly toward and engaging said hull;

said clamp has a middle portion extending across said post;

said first portion of said clamp has a finger curled around said knuckle and engaging said hook at said first side of said post between said knuckle and said tube;

said second portion of said clamp is bolted to said hull.

27. The invention according to claim 26 wherein:

said hook comprises a base pad bonded to the underside of said tube;

said post extends downwardly and outwardly from said base pad;

said second side of said post extends downwardly and outwardly away from said hull such that detachment of said clamp from said hull enables said hull to slide downwardly away from said tube along said second side of said post.

28. The invention according to claim 27 wherein:

said hull has a first upper surface engaging said tube;

said hull has a second upper surface spaced outwardly of said first surface and engaging said base pad;

said hull has a third outer surface extending downwardly and outwardly from said second surface and engaging said second side of said post;

said hull has a fourth lower surface extending inwardly from said third surface and engaging said second portion of said clamp.

29. The invention according to claim 28 wherein said clamp has an upper surface along said finger engaging said base pad, and said clamp extending downwardly and inwardly from said finger along said post and then along said fourth surface of said hull.

30. A RIB, rigid-hull inflatable boat, comprising an inflatable tube having a general U-shape with a forward end at the bight of the U and trailing sides extending rearwardly therefrom along the legs of the U, a hull nested within said tube and detachably secured thereto by a mechanical locking device having a releasable clamp permitting detachment and reattachment of said tube to said hull, wherein said hull has first and second upper surfaces supporting said tube and spaced by a third upper surface recessed below said tube and forming a channel therebetween, said locking device comprises a hook bonded to said tube, said hull has a fourth outer surface extending downwardly and outwardly from said second surface along said hook, said hull has a fifth lower surface extending downwardly and inwardly from said fourth surface, said clamp has a first portion engaging said hook, and a second portion engaging said hull at said fifth surface.

31. The invention according to claim 30 wherein said hull has a sixth lower surface extending inwardly from said fifth surface below and generally parallel to said third surface.

32. A RIB, rigid-hull inflatable boat, comprising an inflatable tube having a general U-shape with a forward end at the bight of the U and trailing sides extending rearwardly therefrom along the legs of the U, a hull nested within said tube and attached thereto, said hull having a concave surface engaging said tube and extending along the U-shape thereof, said concave surface having a recessed channel extending fore to aft therealong and forming a gutter such that water flowing over the top of the tube and then downwardly along the interface between said tube and said hull flows into said gutter.

33. The invention according to claim 32 wherein said channel is open at the aft end of said hull such that water in said gutter drains aft.

34. The invention according to claim 33 wherein said hull is nested to the underside of said tube, and said concave surface has upper and lower sections spaced by said channel therebetween.

35. The invention according to claim 34 wherein said hull is detachably secured to said tube by a mechanical locking device having a releasable clamp permitting detachment and reattachment of said tube to said hull, and including a hook bonded to the underside of said tube, and wherein said clamp clamps said hull to said hook at said lower section.

36. The invention according to claim 33 wherein said gutter extends around the perimeter of said hull in a general U-shape parallel to the U-shape of said tube.

37. The invention according to claim 36 wherein said channel and the lower surface of said hull have parallel extended surfaces at the front of the boat receiving a U-bolt extending therethrough.

38. The invention according to claim 33 wherein said concave surface has an upper reach within the boat, said hull has an upwardly facing deck within the boat below said upper reach, said deck being joined to said upper reach by an inner sidewall extending downwardly from said upper reach and curved outwardly and below said tube and said concave surface and toward said channel to provide a wider beam and increased floor space within the boat.

39. A RIB, rigid-hull inflatable boat, comprising an inflatable tube having a general U-shape with a forward end at the bight of the U and trailing sides extending rearwardly therefrom along the legs of the U, a hull nested to the underside of said tube and attached thereto, said hull having an outer sidewall with a concave surface engaging said tube, said concave surface having an upper reach within the boat, said hull having an upwardly facing deck within the boat below said upper reach, said deck being joined to said upper reach by an inner sidewall extending downwardly from said upper reach and curved outwardly and below said tube and said concave surface to provide an undercut in said inner sidewall to provide a wider beam and increased floor space within the boat.

* * * * *